US005399412A

United States Patent [19]

Sudall et al.

[11] Patent Number: 5,399,412

[45] Date of Patent: Mar. 21, 1995

[54] UNCREPED THROUGHDRIED TOWELS AND WIPERS HAVING HIGH STRENGTH AND ABSORBENCY

[75] Inventors: Stephen J. Sudall, Clywd, Wales; Steven A. Engel, Neenah, Wis.

[73] Assignee: Kimberly-Clark Corporation, Del.

[21] Appl. No.: 65,822

[22] Filed: May 21, 1993

[51] Int. Cl.[6] ..... D21C 9/00; D21H 5/24; D21H 11/00; D21H 17/00

[52] U.S. Cl. ..... 428/153; 428/154; 428/219; 428/220; 428/280; 162/9; 162/56; 162/109; 162/110; 162/123; 162/132; 162/208; 162/210

[58] Field of Search ..... 162/123, 132, 208, 210, 162/109, 110, 9, 56; 428/153, 154, 219, 220, 280

[56] References Cited

U.S. PATENT DOCUMENTS

| | | | |
|---|---|---|---|
| 3,301,746 | 1/1967 | Sanford et al. | 162/113 |
| 3,537,954 | 11/1970 | Justus | 162/305 |
| 3,629,056 | 12/1971 | Forrest | 162/305 |
| 3,692,622 | 9/1972 | Dunning | 161/124 |
| 3,726,750 | 4/1973 | Stillings | 161/57 |
| 3,776,807 | 12/1973 | Dunning et al. | 161/124 |
| 3,806,406 | 4/1974 | Ely | 162/206 |
| 3,812,000 | 5/1974 | Salvucci, Jr. et al. | 162/111 |
| 3,821,068 | 6/1974 | Shaw | 162/111 |
| 3,846,228 | 11/1974 | Ely et al. | 162/206 |
| 3,905,863 | 9/1975 | Ayers | 162/113 |
| 3,926,716 | 12/1975 | Bates | 162/113 |
| 3,974,025 | 8/1976 | Ayers | 162/113 |
| 3,994,771 | 11/1976 | Morgan, Jr. et al. | 162/113 |
| 4,100,017 | 7/1978 | Flautt, Jr. | 162/111 |
| 4,102,737 | 7/1978 | Morton | 162/113 |
| 4,120,747 | 10/1978 | Sarge, III et al. | 162/117 |
| 4,125,430 | 11/1978 | Grossman | 162/207 |
| 4,125,659 | 11/1978 | Klowak et al. | 428/153 |
| 4,127,637 | 11/1978 | Pietreniak et al. | 264/114 |
| 4,157,938 | 6/1979 | Clemens et al. | 162/207 |
| 4,191,609 | 3/1980 | Trokhan | 162/113 |
| 4,196,045 | 4/1980 | Ogden | 162/117 |
| 4,309,246 | 1/1982 | Hulit et al. | 162/113 |
| 4,440,597 | 4/1984 | Wells et al. | 162/111 |
| 4,448,638 | 5/1984 | Klowak | 162/111 |
| 4,464,224 | 8/1984 | Matolcsy | 162/111 |
| 4,469,735 | 9/1984 | Trokhan | 428/154 |
| 4,529,480 | 7/1985 | Trokhan | 162/109 |
| 4,551,199 | 11/1985 | Weldon | 162/109 |
| 4,556,450 | 12/1985 | Chuang et al. | 162/204 |
| 4,637,859 | 1/1987 | Trokhan | 162/109 |
| 4,808,266 | 2/1989 | Faurie | 162/102 |
| 4,940,513 | 7/1990 | Spendel | 162/112 |
| 4,959,125 | 9/1990 | Spendel | 162/158 |
| 5,048,589 | 9/1991 | Cook et al. | 162/109 |
| 5,059,282 | 10/1991 | Ampulski et al. | 162/111 |
| 5,098,519 | 3/1992 | Ramasubramanian et al. | 162/109 |
| 5,098,522 | 3/1992 | Smurkoski et al. | 162/358 |
| 5,126,015 | 6/1992 | Pounder | 162/206 |

*Primary Examiner*—Patrick J. Ryan
*Assistant Examiner*—Richard P. Weisberger
*Attorney, Agent, or Firm*—Gregory E. Croft

[57] ABSTRACT

Uncreped throughdried basesheets can be made with the caliper of the basesheet being independent of the basis weight of the basesheet. Multi-ply wipers and towels produced by plying together two or more of such basesheets having a relatively low basis weight can provide products with improved caliper and absorbency for a given strength level and the amount of fiber used.

40 Claims, No Drawings

UNCREPED THROUGHDRIED TOWELS AND WIPERS HAVING HIGH STRENGTH AND ABSORBENCY

BACKGROUND OF THE INVENTION

In the manufacture of a number of paper products such as hand towels, wipers and the like, a wide variety of product characteristics must be given attention in order to provide a final product with the appropriate blend of attributes suitable for the product's intended purposes. Among these various attributes, improving strength, absorbency, caliper and stretch have always been major objectives, particularly for products sold and used in the service and industrial markets. Traditionally, many of these paper products have been made using a wet-pressing process in which a significant amount of water is removed from a wet laid web by pressing or squeezing water from the web prior to final drying. In particular, while supported by an absorbent papermaking felt, the web is squeezed between the felt and the surface of a rotating heated cylinder (Yankee dryer) using a pressure roll as the web is transferred to the surface of the Yankee dryer. The web is thereafter dislodged from the Yankee dryer with a doctor blade (creping), which serves to partially debond the web by breaking many of the bonds previously formed during the wet-pressing stages of the process. The web can be creped dry or wet. Creping generally improves the softness of the web, but at the expense of a significant loss in strength.

More recently, throughdrying has become a more common means of drying paper webs. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until it is dry. The resulting dried web is softer and bulkier than a conventionally-dried uncreped sheet because fewer bonds are formed and because the web is less compressed. Squeezing water from the wet web is eliminated, although the use of a pressure roll to subsequently transfer the web to a Yankee dryer for creping may still be used.

While there is a processing incentive to eliminate the Yankee dryer and make an uncreped throughdried product, uncreped throughdried sheets are typically stiff and, if not calendered, rough to the touch compared to their creped counterparts. This is partially due to the inherently high stiffness and strength of an uncreped sheet, but is also in part due to the coarseness of the throughdrying fabric onto which the wet web is conformed and dried. As a consequence, the use of uncreped throughdried sheets has been heretofore limited to applications where high strength is paramount. These products have moderate absorbency properties.

Therefore there is a need for an uncreped throughdried paper product with an improved blend of properties for use as a wiper or paper towel.

SUMMARY OF THE INVENTION

It has now been discovered that for certain uncreped throughdried basesheets, particularly relatively low basis weight uncreped throughdried basesheets, the caliper of the basesheet is surprisingly substantially independent of the basis weight of the sheet. (As used herein, a basesheet is the dry sheet coming off the papermaking machine, prior to any post treatments such as calendering, embossing, or the like.) By producing multi-ply towels or wipers from relatively light individual uncreped throughdried basesheet plies, rather than making products from a single, heavy basis weight uncreped sheet, for example, improved properties can be obtained relative to the amount of fiber used, particularly in regard to absorbency and caliper for a given strength level. As a result, multi-ply towels and wipers can be produced which have greater wet and dry caliper than current commercial products while possessing a blend of properties which match or exceed those of the better creped multi-ply products and exceed those of previous uncreped throughdried products.

It has also been discovered that the aqueous absorbent capacity of certain uncreped throughdried basesheets is also independent of the caliper of the sheet imparted by dry post-treatments such as creping, embossing or calendering. Unlike conventional wet-pressed creped paper webs which collapse when exposed to water, the uncreped sheets of some embodiments of this invention substantially increase in thickness when exposed to water such that the ratio of the Wet Caliper to the Dry Caliper is about 1.5 or greater. For product uses in which cleaning up water or aqueous spills is important, the presence of a wet strength resin in the fiber furnish used for making the sheet is preferred, since the wet strength resin enhances the wet "memory" of the sheet to allow the sheet to return when wetted to its condition prior to the dry post treatment. However, the presence of a wet strength resin is not necessary for products solely used for wiping up oil or other nonpolar liquids, such as some industrial wipers.

Hence, in one aspect the invention resides in a method of making an uncreped throughdried sheet comprising: (a) depositing an aqueous suspension of papermaking fibers onto a foraminous forming fabric which retains the fibers and allows water to pass through to form a wet web; (b) dewatering the web to a consistency of from about 10 to about 30 percent; (c) transferring the dewatered web to a throughdrying fabric having a 3-dimensional surface contour such that the z-directional dimension or depth of the surface contour is substantially greater than the thickness of the wet web and conforming the wet web to the surface contour of the throughdrying fabric by positive and/or negative pressure; and (d) throughdrying the web, wherein the Dry Caliper (hereinafter defined) of the dried web is substantially independent of the basis weight of the web.

In another aspect, the invention resides in an uncreped throughdried basesheet having a Dry Caliper which is independent of the basis weight of the basesheet, said basesheet having a Dry Caliper of about 0.4 millimeters or greater, an Aqueous Absorbent Capacity of about 500 percent or greater, and a machine direction stretch of about 10 percent or greater.

In another aspect, the invention resides in a calendered multiply cellulosic product useful as a wiper or towel comprising two or more uncreped throughdried plies having a basis weight of from about 10 to about 30 grams per square meter per ply and containing a wet strength resin, wherein the ratio of the Wet Caliper to the Dry Caliper of the product is about 1.5 or greater.

In another aspect, the invention resides in a multi-ply cellulosic product useful as a wiper or towel comprising two or more uncreped throughdried sheets or plies having a basis weight of from about 10 to about 30 grams per square meter per ply, a machine direction tensile strength of about 1000 grams or greater per ply, and an uncalendered Dry Caliper and/or a Wet Caliper (hereinafter defined) of about 0.4 millimeter per ply or greater.

In another aspect, the invention resides in a multi-ply cellulosic product useful as a wiper or towel comprising two or more uncreped throughdried plies and having an Aqueous Absorbent Capacity independent of the Dry Caliper of the product. For two-ply products, the calendered Dry Caliper can suitably be from about 0.3 to about 0.6 millimeter. For three-ply products, the calendered Dry Caliper can suitably be from about 0.5 to about 1 millimeter. For four-ply products, the calendered Dry Caliper can suitably be from about 1 to about 1.3 millimeters. The Aqueous Absorbent Capacity for all such products can be about 1000 percent or greater.

In another aspect, the invention resides in a multi-ply cellulosic product useful as a wiper or towel comprising two or more uncreped throughdried sheets or plies having a basis weight of from about 10 to about 30 grams per square meter per ply and having a machine-direction tensile strength of about 1000 grams or greater per ply, said multi-ply product having an Aqueous Absorbent Capacity of about 800 percent or greater and an Aqueous Absorbent Rate of about 1 second or less.

In a further aspect, the invention resides in a multi-ply cellulosic product useful as a wiper or towel comprising two or more uncreped throughdried sheets or plies having a basis weight of from about 10 to about 30 grams per square meter per ply and a machine-direction tensile strength of about 1000 grams or greater per ply, said multi-ply product having an Oil Absorbent Capacity of about 300 weight percent or greater and an Oil Absorbent Rate of about 20 seconds or less.

These and other aspects of this invention will be described in greater detail herein.

Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish. It has been found that a high quality product having a unique balance of properties can be made using predominantly secondary fibers or all secondary fibers.

The finished basis weight of the individual throughdried sheets or plies used for purposes of this invention can preferably be from about 10 to about 30 gsm, more particularly from about 15 to about 25 gsm, and still more particularly about 20 gsm. These throughdried sheets can be plied together to form a multi-ply product having two, three, four or more plies. These multi-ply products have unexpectedly high caliper and absorbency characteristics for the amount of fiber involved. The basis weight of the multi-ply products of this invention depend upon the number of plies and the basis weight of each ply.

Wet strength resins can be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene®), Henkel Corp. (Fibrabond®), Borden Chemical (Cascamide®), Georgia-Pacific Corp. and others. These polymers are characterized by having a polyamide backbone containing reactive crosslinking groups distributed along the backbone. Other agents that have been found useful in the present invention include wet strength agents based on formaldehyde crosslinking of polymeric resins. These are typified by the urea-formaldehyde and melamine formaldehyde-type wet strength resins. While not used as commonly as the polyamide-polyamine epichlorohydrin type resins, they are still useful in the present invention. Yet a third class of wet strength resins found to be useful in the invention are those classed as aldehyde derivatives of polyamide resins. These are exemplified by materials marketed by American Cyanamid under the Parez® tradename as well as materials described in U.S. Pat. Nos. 5,085,736; 5,088,344 and 4,981,557 issued to Procter & Gamble.

Effective amounts of added resin suitable for purposes of this invention are from about 4 pounds of resin (dry solids) per ton of fiber, up to about 30 pounds of resin (dry solids) per ton of fiber. The exact amount of material will depend on the specific type of resin used, the type of fiber used, the type of forming apparatus used, and the product requirements. Typically the preferred amounts of resin used would be in the range of from about 5 to about 20 pounds of resin per ton of fiber, with a particularly preferred range of from about 8 to about 16 pounds per ton of fiber. These materials are typically added close to the wet end of the paper machine and are absorbed onto the surface of the fiber and the fines prior to the formation of the sheet. Differences in the amounts of resin necessary to bring about the desired effects result from different resin efficiencies, differences in the fibers and the types of contaminants that might be contained in or with the fibers (particularly important when using secondary or recycled fibers).

Suitable formation processes include Fourdrinier and other conventional forming processes well known in the papermaking industry. Twin wire formers are particularly well suited for the relatively low basis weights associated with the towels and wipers of this invention. Forming wires or fabrics can also be conventional, the finer weaves with greater fiber support being preferred to produce a more smooth sheet or web. Suitable forming fabrics include those made by Asten Forming Fabrics Inc., Appleton, Wis. and designated 856A or 866A. Also suitable are 100 mesh stainless steel or monofilament wires or fabrics.

The drying process can be any noncompressive drying method which tends to increase the caliper or thickness of the wet web, including, without limitation, throughdrying, infra-red irradiation, microwave drying, etc. Because of its commercial availability and practicality, throughdrying is a well-known and preferred means for noncompressively drying the web. The throughdrying process and tackle can be conventional as is well known in the papermaking industry. Suitable throughdrying processes are described in U.S. Pat. No. 5,048,589 to Cook et al. (1991) entitled "Non-Creped Hand or Wiper Towel" and U.S. Pat. No. 4,440,597 to Wells et al. (1984) entitled "Wet-Microcontracted Paper and Concomitant Process", which are herein incorporated by reference.

A high degree of stretch in the sheet is desireable and can be achieved using a differential speed or rush transfer between the forming fabric and the throughdryer fabric, as described in the above-mentioned Wells patent, or between any other fabrics used in the wet end of the process. The use of one or more transfer fabrics between the forming fabric and the throughdrying fabric, as disclosed in commonly assigned co-pending application Ser. No. 08/036,649 entitled "Method For Making Smooth Uncreped Throughdried Sheets" filed Mar. 24, 1993 in the name of Steven A. Engel et al., can also be used to provide increased stretch and produce a smoother sheet. An amount of stretch of from about 5 to about 40 percent, preferably from about 15 to about 30 percent in the dried uncreped sheet is preferred. Suitable throughdrying fabrics include, without limitation, Asten 920A and 937A, and Velostar P800 and 103A, also made by Asten. These fabrics exhibit sufficient 3-dimensionality to provide caliper independent of basis weight of the web. The 3-dimensionality of the fabrics can be quantified by the z-directinal distance between the warp knuckles and the shute knuckles of the fabric. The above-mentioned fabrics have such a distance ranging from about 0.17 millimeter to about 0.38 millimeter. It is expected that multiple layer fabrics can have even greater 3-dimensionality. By way of example, using an Asten Velostar P800 throughdrying fabric in accordance with this invention, uncreped throughdried sheets having basis weights of about 14, 18, 21, 27, 30 and 32 grams per square meter all exhibited substantially the same dry caliper of about 0.5 millimeter as determined by a different, but similar, caliper measurement method.

Ply attachment of the various uncreped throughdried plies to form the products of this invention can be performed by any ply attachment means as is well known in the paper industry. Crimping is a preferred ply attachment means. The multi-ply products of this invention hereinafter described in the Examples are plied together with the smoother side of the outer plies facing outwardly. The smoother side of the ply is the side not in contact with the throughdrying fabric during drying, often referred to as the "air side" of the sheet. The side of the sheet which is in contact with the throughdrying fabric during drying is often referred to as the "dryer side" of the sheet. It is believed that even greater caliper for multi-ply products can be obtained by plying the air sides of adjacent plies together.

Products of this invention can have a machine direction tensile strength of about 1000 grams per ply or greater, preferably about 2000 grams per ply or greater, depending on the product form, and a machine direction stretch of about 10 percent or greater, preferably from about 15 to about 25 percent. More specifically, the preferred machine direction tensile strength for hand towels is about 1500 grams or greater, whereas the preferred machine direction tensile strength for wipers is about 2000 grams or greater. Two-ply products of this invention can have machine direction tensile strengths of about 4000 grams or greater, three-ply products of this invention can have machine direction tensile strengths of about 5500 grams or greater, and four-ply products of this invention can have machine direction tensile strengths of about 7500 grams or greater, which is high for multi-ply products. Tensile strength and stretch is measured according to ASTM D1117-6 and D1682. As used herein, tensile strengths are reported in grams of force per 3 inches (7.62 centimeters) of sample width, but are expressed simply as "grams" for convenience.

The Aqueous Absorbent Capacity of the products of this invention is at least about 500 weight percent, more preferably about 800 weight percent or greater, and still more preferably about 1000 percent or greater. It refers to the capacity of a product to absorb water over a period of time and is related to the total amount of water held by the product at its point of saturation. The specific procedure used to measure the "Aqueous Absorbent Capacity" is described in Federal Specification No. UU-T-595C and is expressed, in percent, as the weight of water absorbed divided by the weight of the sample product.

The products of this invention can also have an Aqueous Absorbent Rate of about 1 second or less. "Aqueous Absorbent Rate" is the time it takes for a drop of water to penetrate the surface of a towel or wiper in accordance with Federal Specification UU-P-31b.

The Oil Absorbent Capacity of the products of this invention can be about 300 weight percent or greater, preferably about 400 weight percent or greater, and suitably from about 400 to about 550 weight percent. The procedure used to measure "Oil Absorbent Capacity" is measured in accordance with Federal Specification UUT 595B.

The products of this invention exhibit an Oil Absorbent Rate of about 20 seconds or less, preferably about 10 seconds or less, and more preferably about 5 seconds or less. Oil Absorbent Rate is measured in accordance with Federal Specification UU-P-31b.

The Dry Caliper of the multi-ply products of this invention is about 0.6 millimeters or greater, preferably about 0.9 millimeters or greater, and suitably from about 0.8 to about 1.3 millimeters. The Dry Caliper of the individual uncalendered basesheets or plies of the multi-ply products of this invention is about 0.4 millimeters per ply or greater, preferably about 0.6 millimeters per ply or greater, and suitably from about 0.4 to about 0.8 millimeters. Dry Caliper is the thickness of a dry product or ply measured under a controlled load. The method for determining Dry Caliper utilizes a Starrett dial gauge (Model 2320 available from Mitutoyo Corporation, Landic Mita Building, 31-19 Shiba, 5-Chome, Minato-Ku, Tokyo 108, Japan) and a plastic block (LUCITE®) measuring 100 millimeters × 100 millimeters. The center of the LUCITE block is marked to enable the gauge point to be centered on the block. The thickness of the block is such as to give a total force exerted on the sample by the weight of the block and the gauge spring of 225 grams. A sample of the material to be measured is cut to a size of 100 millimeters × 100 millimeters. There can be no folds, creases or wrinkles in the sample. The sample is placed under the LUCITE block and the block and the sample are placed under the gauge point with the gauge point centered on the block. The gauge point is gently released and the Dry Caliper is read to the nearest 0.01 millimeter after 15 to 20 seconds. The procedure is repeated for four additional representative samples and the results of the five samples are averaged.

The Wet Caliper of the multi-ply products of this invention can be about 0.60 millimeters or greater. For three ply-products, the Wet Caliper can suitably be from about 0.70 to about 1.2 millimeters. Four-ply products will have higher calipers. The Wet Caliper of the individual plies can be about 0.4 millimeters or greater, preferably about 0.6 millimeters or greater, and suitably from about 0.4 to about 0.8 millimeters. Wet Caliper is measured similarly to the method described above for Dry Caliper, except the sample is immersed in a water bath until it is completely saturated. The sample is withdrawn from the water by carefully holding two adjacent corners of the sample and removing excess water by letting the sample drag across the edge of the water bath container as the sample is being removed. The sample is lowered onto the underside of the LUCITE block from one edge (not one corner) to prevent formation of bubbles, creases and wrinkles. Measurement of the Wet Caliper is then carried out as described above for the Dry Caliper.

These and other aspects of this invention will be described in greater detail in the following examples.

EXAMPLES

Example 1

An aqueous suspension of 100% secondary papermaking fibers containing about 0.2 weight percent fibers was prepared. The fiber suspension was fed to a twin wire headbox (flowbox) and deposited onto a forming fabric. The forming fabric was an Asten 866 having a void volume of 64.5%. The speed of the forming fabric was 2234 feet per minute. The newly-formed web was dewatered to a consistency of about 20 weight percent using vacuum suction from below the forming fabric before being transferred to a transfer fabric which was traveling at a speed of 1862 feet per minute (20% differential speed). The transfer fabric was an Asten 937 fabric with a void volume of 61.6%. The fabrics were positioned such that the forming fabric was in close proximity to the transfer fabric. The transfer shoe was positioned behind the transfer fabric and moved into the forming fabric such that it displaces the transfer fabric but not the forming fabric. This positioning is referred to in the papermaking art as tangential contact or kiss contact between the fabrics. The vacuum shoe was pulling a vacuum of 5 inches of mercury to make the transfer without compacting the web. The web was then transferred to an Asten Velostar 800 throughdryer fabric traveling at a speed of 1862 feet per minute. The web was carried over a Honeycomb throughdryer operating at a temperature of about 350° F. and dried to final dryness (about 2 percent moisture). The resulting basesheet was wound into a softroll and thereafter plied together with a like basesheet by edge crimping to produce a two-ply towel.

Example 2

A two-ply towel was made as described in Example 1, except the resulting two-ply product was lightly calendered at a pressure of about 1 pound per lineal inch.

Example 3

A two-ply towel was made as described in Example 2, except the calendering pressure was about 58 pounds per lineal inch.

Example 4

A two-ply towel was made as described in Example 2, except the calendering pressure was about 112 pounds per lineal inch.

Example 5

A three-ply towel was made by crimping together three plies of a basesheet made as described in Example 1 and lightly calendering the three-ply product.

Example 6

A four-ply towel was made by crimping together four plies of a basesheet made as described in Example 1 and lightly calendering the four-ply product.

The physical properties of the products made as described above were measured and are set forth in TABLE 1 below. For comparison, the properties of some commercially available towels and wipers are set forth in TABLE 2. As used in TABLES 1 and 2, "Technology" refers to the method by which the product is made: "UCTAD" means uncreped throughdried; "CTAD" means creped throughdried; and "CWP" means creped wet-pressed. Other terms used in the tables and their meanings are as follows: "Basis wt" is the basis weight of the product, expressed in grams per square meter; "Plies" are the number of plies in the product; "MD Tensile" is the machine-direction tensile strength, expressed in grams per 3 inches (7.62 centimeters); "CD Tensile" is the cross-machine tensile strength, expressed in grams per 3 inches (7.62 centimeters); "Aqueous Abs Cap" is the Aqueous Absorbent Capacity, expressed in weight percent; "Aqueous Abs Rate" is the Aqueous Absorbent Rate, expressed in seconds; "Oil Abs Cap" is the Oil Absorbent Capacity, expressed in weight percent; "Oil Abs Rate" is the Oil Absorbent Rate, expressed in seconds; "Dry Cal" is the Dry Caliper, expressed in millimeters; "Wet Cal" is the Wet Caliper, expressed in millimeters; and "Stretch" is the machine-direction stretch, expressed as percent elongation.

TABLE 1

| | (Products of This Invention) | | | | | |
|---|---|---|---|---|---|---|
| Product | Ex. 1 | Ex. 2 | Ex. 3 | Ex. 4 | Ex. 5 | Ex. 6 |
| Technology | UCTAD | UCTAD | UCTAD | UCTAD | UCTAD | UCTAD |
| Basis wt | 44.70 | 43.85 | 42.41 | 42.50 | 65.4 | 84.5 |
| Plies | 2 | 2 | 2 | 2 | 3 | 4 |
| MD Tensile | 4122 | 4012 | 3970 | 3959 | 5470 | 7630 |
| CD Tensile | 4244 | 4098 | 3870 | 3885 | 5570 | 5460 |
| Aqueous Abs Cap | 1060 | 1084 | 1104 | 1000 | 1060 | 1235 |
| Aqueous Abs Rate | 0.62 | 0.64 | 0.66 | 0.68 | 0.70 | 0.70 |
| Oil Abs Cap | 435 | 430 | 395 | 300 | 445 | 445 |
| Oil Abs Rate | 2.3 | 2.3 | 7.0 | 11.5 | 3.0 | 2.5 |
| Dry Cal | 0.91 | 0.63 | 0.41 | 0.31 | 1.01 | 1.25 |
| Wet Cal | 0.82 | 0.71 | 0.62 | 0.57 | 1.09 | 1.37 |
| Stretch | 20.5 | 19.1 | 16.3 | 16.8 | 18.0 | 17.0 |

TABLE 2

| Product | (Commercially Available Products) BOUNTY ® | SURPASS ® | KLEENEX ® | KLEENEX ® |
|---|---|---|---|---|
| Technology | CTAD | UCTAD | CWP | UCTAD |
| Basis wt | 49.00 | 47.4 | 47 | 49 |
| Plies | 2 | 1 | 2 | 1 |
| MD Tensile | 2415 | 6460 | 3145 | 3615 |
| CD Tensile | 1810 | 4180 | 3305 | 3515 |
| Aqueous Abs Cap | 1015 | 360 | 425 | 470 |
| Aqueous Abs Rate | 0.5 | 3.9 | 1.70 | 1.70 |
| Oil Abs Cap | 550 | 305 | 275 | 275 |
| Oil Abs Rate | 3.6 | 85.0 | 12.3 | 100.0 |
| Dry Cal | 0.66 | 0.49 | 0.29 | 0.35 |
| Wet Cal | 0.66 | 0.44 | 0.29 | 0.48 |
| Stretch | 15.0 | 5.0 | 24.0 | 5.0 |

These results show that the multi-ply uncreped throughdried products of this invention have a higher caliper (uncalendered) than any of the commercial products of Table 2 as a result of the caliper being independent of the basis weight, and a better balance of properties, including strength and absorbency.

It will be appreciated that the foregoing examples, given for purposes of illustration, are not to be construed as limiting the scope of this invention, which is defined by the following claims and all equivalents thereto.

We claim:

1. An uncreped throughdried basesheet having a Dry Caliper which is independent of the basis weight of the basesheet, said basesheet having a Dry Caliper of about 0.4 millimeters or greater, an Aqueous Absorbent Capacity of about 500 percent or greater, and a machine direction stretch of about 10 percent or greater.

2. A calendered multi-ply cellulosic product useful as a wiper or towel comprising two or more uncreped throughdried plies having a basis weight of from about 10 to about 30 grams per square meter per ply and containing a wet strength resin, wherein the ratio of the Wet Caliper to the Dry Caliper is about 1.5 or greater.

3. A multi-ply cellulosic product useful as a wiper or towel comprising two or more uncreped throughdried plies having a basis weight of from about 10 to about 30 grams per square meter per ply, a machine-direction Tensile Strength of about 1000 grams or greater per ply, and an uncalendered Dry Caliper of about 0.4 millimeters per ply or greater.

4. The product of claim 3 comprising two uncreped throughdried plies and having a combined Dry Caliper of about 0.9 millimeter or greater.

5. The product of claim 3 comprising three uncreped throughdried plies and having a combined Dry Caliper of about 1 millimeter or greater.

6. The product of claim 3 comprising four uncreped throughdried plies and having a combined Dry Caliper of about 1.2 millimeters or greater.

7. The product of claim 3 wherein the Dry Caliper is about 0.6 millimeter per ply or greater.

8. The product of claim 3 wherein the Dry Caliper is from about 0.4 to about 0.8 millimeters per ply.

9. The product of claim 3 wherein the Wet Caliper is about 0.4 millimeters per ply or greater.

10. The product of claim 3 wherein the Wet Caliper is about 0.6 millimeters per ply or greater.

11. The product of claim 3 wherein the Wet Caliper is from about 0.4 to about 0.8 millimeters per ply.

12. The product of claim 3 having a machine-direction stretch of about 10 percent or greater.

13. The product of claim 3 having a machine-direction stretch of from about 15 to about 30 percent.

14. The product of claim 3 having a machine-direction stretch of about 20 percent.

15. The product of claim 3 having an Aqueous Absorbent Capacity of about 800 percent or greater.

16. The product of claim 3 having an Aqueous Absorbent Capacity of about 1000 percent or greater.

17. The product of claim 3 having an Oil Absorbent Capacity of about 300 percent or greater.

18. The product of claim 3 having an Oil Absorbent Capacity of about 400 percent or greater.

19. The product of claim 3 having an Oil Absorbent Capacity of from about 400 to about 550 percent.

20. The product of claim 3 having an Oil Absorbent Rate of about 20 seconds or less.

21. The product of claim 3 having an Oil Absorbent Rate of about 5 seconds or less.

22. The product of claim 3 wherein the plies predominantly contain secondary fibers.

23. The product of claim 3 having two plies and a machine direction Tensile Strength of about 4000 grams or greater.

24. The product of claim 3 having three plies and a machine direction Tensile Strength of about 5500 grams or greater.

25. The product of claim 3 having four plies and a machine direction Tensile Strength of about 7500 grams or greater.

26. A calendered multi-ply cellulosic product useful as a wiper or towel comprising two or more uncreped throughdried plies and having an Aqueous Absorbent Capacity independent of the Dry Caliper of the product.

27. The product of claim 26 having an Aqueous Absorbent Capacity of about 800 percent or greater.

28. The product of claim 26 having two plies and a Dry Caliper of from about 0.3 to about 0.6 millimeter.

29. The product of claim 26 having three plies and a Dry Caliper of from about 0.5 to about 1 millimeter.

30. The product of claim 26 having four plies and a Dry Caliper of from about 1 to about 1.3 millimeters.

31. The product of claim 26 containing predominantly secondary fibers.

32. A multi-ply cellulosic product useful as a wiper or towel comprising two or more uncreped throughdried plies having a basis weight of from about 10 to about 30 grams per square meter per ply and having a machine-direction Tensile Strength of about 1000 grams or greater per ply, said multi-ply product having an Aqueous Absorbent Capacity of about 800 percent or greater and an Aqueous Absorbent Rate of about 1 second or less.

33. The product of claim 32 containing predominantly secondary fibers.

34. A multi-ply cellulosic product useful as a wiper or towel comprising two or more uncreped throughdried plies having a basis weight of from about 10 to about 30 grams per square meter per ply and a machine direction Tensile Strength of about 1000 grams or greater per ply, said multi-ply product having an Oil Absorbent Capacity of about 300 weight percent or greater and an Oil Absorbent Rate of about 20 seconds or less.

35. The product of claim 34 containing predominantly secondary fibers.

36. A multi-ply cellulosic product useful as a wiper or towel comprising two or more uncreped throughdried plies having a basis weight of from about 10 to about 30 grams per square meter per ply, a machine-direction Tensile Strength of about 2000 grams or greater, a Dry Caliper of about 0.4 millimeters or greater per ply, a Wet Caliper of about 0.4 millimeters or greater per ply, an Oil Absorbent Capacity of about 300 percent or greater, an Aqueous Absorbent Capacity of about 800 percent or greater, an Oil Absorbent Rate of about 20 seconds or less, and a machine direction stretch of from about 10 percent or greater.

37. The product of claim 36 having two uncreped throughdried plies.

38. The product of claim 36 having three uncreped throughdried plies.

39. The product of claim 36 having four uncreped throughdried plies.

40. The product of claim 36 containing predominantly secondary fibers.

* * * * *